United States Patent [19]

Santi

[11] Patent Number: 4,458,369

[45] Date of Patent: Jul. 10, 1984

[54] WATER DISPENSING UNIT FOR SHOWER BATHS AND THE LIKE

[75] Inventor: Carlo Santi, Milan, Italy

[73] Assignee: Rubinetteria Stella S.p.A., Milan, Italy

[21] Appl. No.: 443,509

[22] Filed: Nov. 22, 1982

[30] Foreign Application Priority Data

Feb. 19, 1982 [IT] Italy ..... 20904/82[U]

[51] Int. Cl.[3] ..... A47K 3/22

[52] U.S. Cl. ..... 4/596; 4/615; 4/605

[58] Field of Search ..... 4/596, 605, 615, 599, 4/597, 600, 602, 603, 605

[56] References Cited

U.S. PATENT DOCUMENTS

| | | | |
|---|---|---|---|
| 3,629,875 | 12/1971 | Dow | 4/599 |
| 3,837,013 | 9/1974 | Davis et al. | 4/605 |
| 4,003,666 | 1/1977 | Gaines | 277/212 FB |
| 4,121,845 | 10/1978 | Reynolds | 277/212 FB |
| 4,154,546 | 5/1979 | Merrick | 277/212 FB |
| 4,174,822 | 11/1979 | Larsson | 4/615 |
| 4,201,391 | 5/1980 | Bankstahl | 277/212 FB |
| 4,224,700 | 9/1980 | Bloys | 4/596 |
| 4,324,318 | 4/1982 | Karasudani | 277/212 FB |
| 4,419,027 | 12/1983 | Trudeau | 277/212 FB |

*Primary Examiner*—Henry K. Artis

*Attorney, Agent, or Firm*—Guido Modiano; Albert Josif

[57] ABSTRACT

The dispensing unit comprises a water dispensing element supported by a holder element adapted for wall mounting, between the water dispensing element and the holder element there being provided a dovetail connection system comprising a male element slidably engageable in a female member, the latter being defined by a shaped groove gradually narrowing in a parallel direction to its major dimension direction.

6 Claims, 8 Drawing Figures

WATER DISPENSING UNIT FOR SHOWER BATHS AND THE LIKE

BACKGROUND OF THE INVENTION

This invention relates to a water dispensing unit for shower baths and the like.

As is known, various types of shower bath units are currently available commercially. One of the most widely used such units includes a supporting fork element having protruding lugs adapted to hold the dispensing element. In other instances, the supporting element is merely a wall-mounted hook adapted to fit into a slot purposely formed on the head of the water dispensing element.

Such prior shower bath units have the important disadvantage that the protruding lugs of the fork element, or the hang-up hooks, for the dispensing element are potentially hazardous in that, owing to their standout configuration, it is quite easy to bump against them and get hurt.

Another disadvantage of conventional shower bath units is that they are often expensive to manufacture and, accordingly, uneconomical.

SUMMARY OF THE INVENTION

It is a primary object of this invention to remove the disadvantages affecting conventional shower bath units by providing a more functional such unit.

A further object of the invention is to provide a shower bath unit which is not liable to cause injury to the user by eliminating the hazard of protruding appendages.

It is another object of this invention to provide such a shower bath unit, which is simple to manufacture and hence economical.

An additional object of the invention is to provide such a shower bath unit which is easy to operate and can fit any type of supporting wall.

According to one aspect of the present invention, these and other objects, such as will be apparent hereinafter, are achieved by a water dispensing unit for shower baths and the like, comprising a water dispensing element and a holder element for supporting the dispensing element, said holder element being adapted for wall mounting, characterized in that rabbeted connection means are provided between said dispensing element and said holder element.

BRIEF DESCRIPTION OF THE DRAWINGS

Further features and advantages will be more apparent from the following detailed description of a water dispensing unit for shower baths and the like, according to the invention, as illustrated by way of example only in the accompanying drawings, where.

DESCRIPTION OF THE PREFERRED EMBODIMENT

Figure 3:
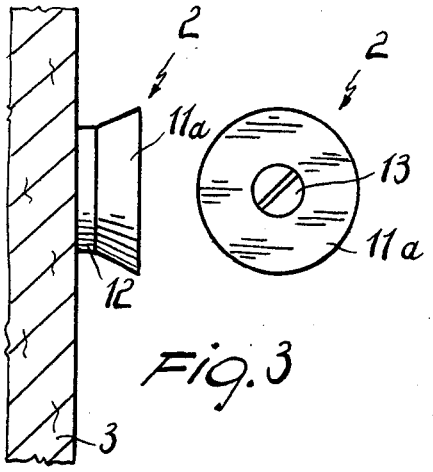
FIG. 3 is a side and plan view of the holder element shown in FIGS. 1 and 2.
Figure 8:
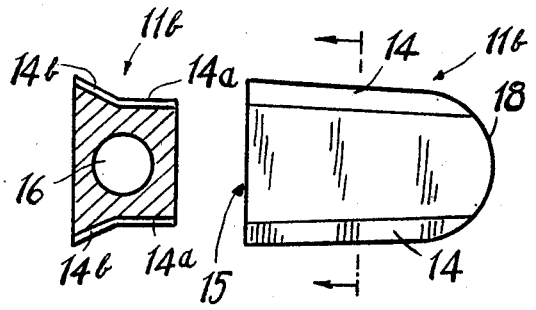
FIG. 8 is a detail view of the holder element of FIG. 4, respectively in section, as viewed from above, and in perspective.

Making reference to the drawing figures, the water dispensing unit for shower baths and the like, according to this invention, comprises a water dispensing element or shower head 1 and a holder element or support 2, for mounting to a wall 3. The dispenser element 1 has a first face 4 and a second face 5, which are connected to each other through a lateral surface or portion 6 which, as visible from the drawing figures, circumferentially extends trasversely to said faces 4 and 5 and is formed with a groove or at least partially circumferential recess 7 which defines a grip formation functioning as the handle of the shower head 1. Since the handle of the dispensing element 1 is provided incorporated to it, differently from conventional shower bath units, there is no separate handle, so that the water supply hose 8 will be connected directly to the element 1.

On the face 4 of the water dispensing element 1, there are formed spray nozzle defining water outlet holes 9, while on the face 5 a shaped groove 10 is provided which extends from one edge of the face 5 to the diametrically opposite edge. Said groove 10 narrows gradually and parallel to its major dimension direction from the closest edge to the point of connection to the hose 8. Said groove gradually widens from the face 5 towards its bottom so as to define a trapezium in cross-section and constitutes a female member intended to cooperate with a male member **11*a* or 11*b* provided on the holder element 2**, such as to produce a dovetail type of rabbeted connection.

Figure 2:
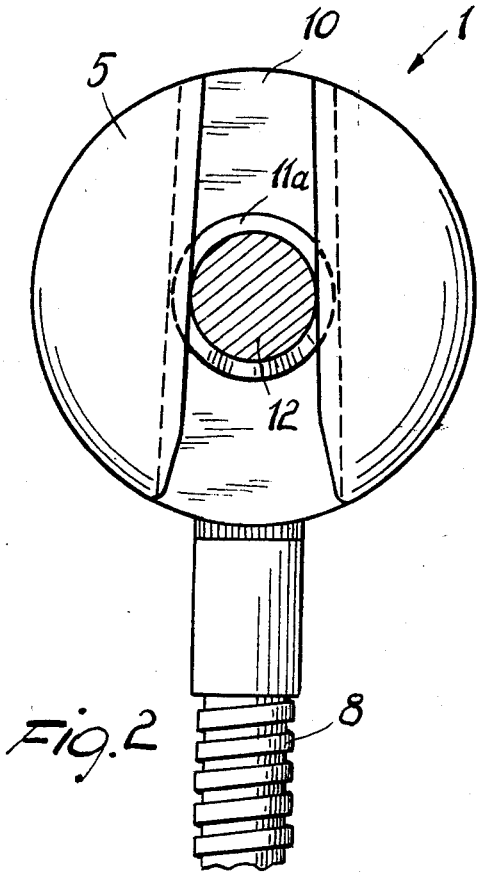
FIG. 2 is a rear view of the unit of FIG. 1, wherein the holder element is shown in section.
Figure 4:
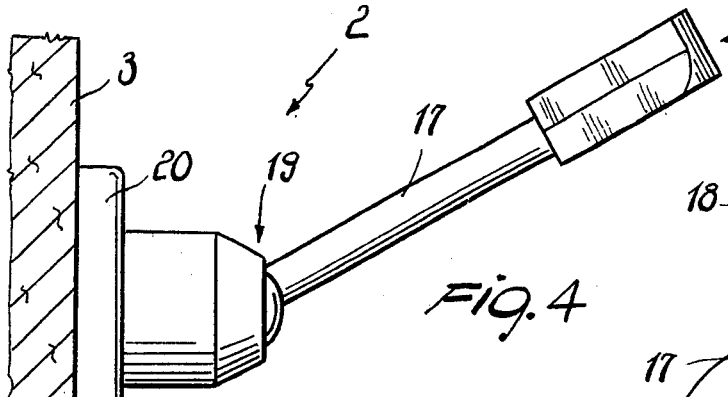
FIG. 4 shows a second holder element of the swivel type.
Figure 5:
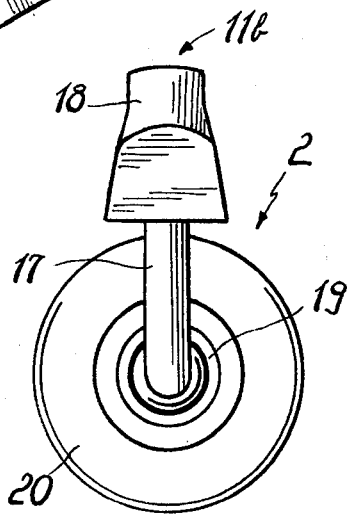
FIG. 5 is a front view of the holder element of FIG. 4.
Figure 6:
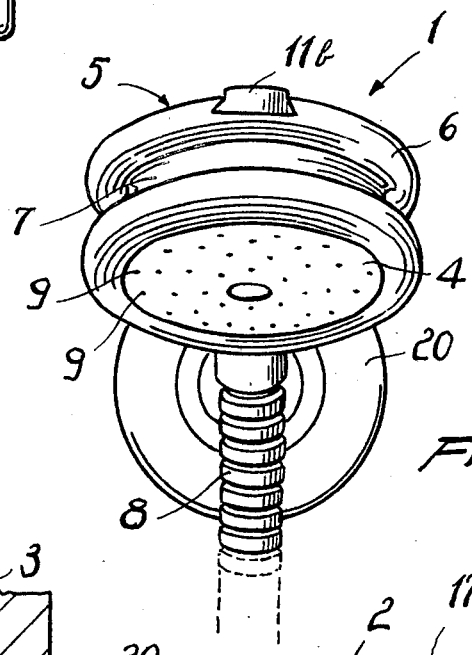
FIG. 6 is a front view of the dispensing unit, with the holder element of FIG. 4.
Figure 7:
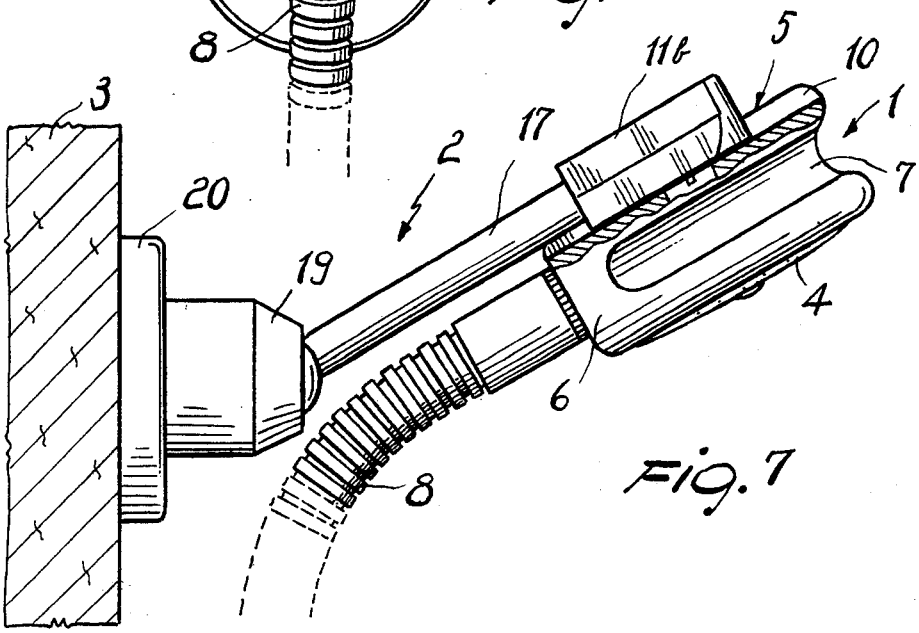
FIG. 7 is a partly sectional side view of the shower bath unit, as incorporating the second type of holder element.

In fact, as best visible in FIG. 2 (doted lines) and FIG. 6, the sidewalls of groove 10 are convergent in a first direction leading from the bottom of the groove and in a second direction extending longitudinally to the groove 10.

Figure 1:
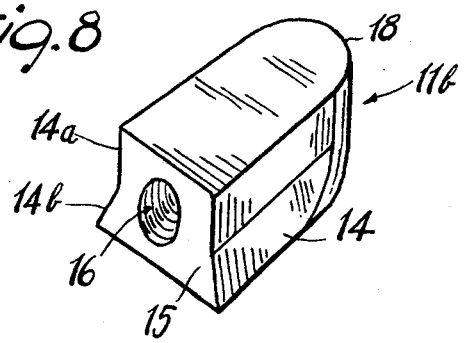
FIG. 1 is a partly sectional side view of the water dispensing unit, as comprising a first type of holder element.
Figure 1:
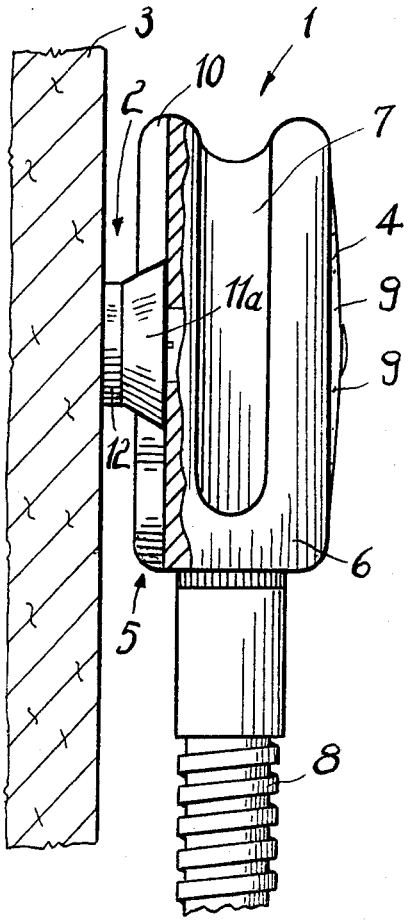

The holder element 2 may be variously configured. As an example, in FIGS. 1 or 3, it is implemented as a one-piece construction including a cylindrical portion 12 forming a base body and a truncated cone mating portion **11*a* which constitutes the male member of the rabbet and engages in the groove 10**.

Also provided is a screw 13 for fastening the holder element 2 to a wall.

Another embodiment of the holder element 2 is shown in FIGS. 4–8. Here, the male member **11*b* comprises an elongate body whose sidewalls 14 (as shown more clearly in the sectional view of FIG. 8) include two mutually parallel portions 14*a* and two diverging portions 14*b*, the latter two portions cooperating with the groove 10. Again with reference to FIG. 8, the elongate body 11*b* is formed, at a lateral surface 15 thereof, with a threaded hole 16 through which the end of a rod 17 is threaded. The lateral surfaces 14, on the opposite side to that adjacent the surface 15, are interconnected by a curved surface 18 such that the inwardly projecting end of the elongate body 11*b*** is made free of any sharp corners potentially hazardous for the user.

The rod 17 is connected, through a ball joint system 19, to a base body 20 for securing the holder element 2 to the wall 3.

As visible from the drawing figures in both embodiments the transversal dimentions of the mating portion 11*a*, 14*b* are smaller than the transversal dimentions of the groove at the first end portion thereof near the hose 8 but bigger than the transversal dimensions of the groove at the opposite end portion thereof.

The operation and utilization of the water dispensing unit for shower baths according to this invention is apparent from the foregoing description. In particular, it should be noted that in the embodiment shown in FIGS. 1-3, the holder element is stationary, and, to use the shower, the dispenser element 1 must be removed from the holder element 2, whereas in the embodiment shown in FIGS. 4-8 the dispenser element may be left engaged in the holder element 2 while in use, the swivel element enabling it to be positioned as desired.

In both cases, however, to release the connection between the dispenser element and holder element, it is necessary that the former be moved in a parallel direction to the major dimension direction of the groove, until the male member locates at the wider end of the groove, while, to place the dispenser element back into its home position the reverse operation must be performed, until the male member fits into the groove by virtue of the decreasing width of the latter.

It may be seen from the foregoing description that the invention fully achieves its objects. In fact, the shower bath unit is extremely functional, thanks to the handle being provided on the water dispensing element itself.

Furthermore, the shower bath unit of this invention is in no way hazardous, since any pointed projecting appendages have been effectively eliminated. Also, the water dispensing unit according to the invention is economical and simple to manufacture and use, and adaptable to any type of wall.

Lastly, it is important to observe that this water dispensing unit for shower baths is also advantageous in relation to its specific technical aspects as may be inferred from the specification and from the drawings, and as it will be apparent to those skilled in the art.

In practicing the invention, the materials, shapes, and dimensions may be any selected ones to meet individual requirements.

I claim:

1. A water dispensing unit for shower baths and the like, comprising a shower head and a support, said shower head having a first face and a second face, said faces generally extending in planes, substantially parallel to each other, a lateral circumferential surface extending transverse to said first and second faces and connecting said faces to each other, said first face having means defining a spray nozzle, said second face having a groove with a longitudinal extension, a groove aperture and opposite thereto a bottom and with side walls, said side walls being convergent in a first direction leading from the groove bottom towards the groove aperture and in a second direction parallel to the longitudinal extension of the groove, thereby said groove having at one longitudinal end zone thereof a larger groove aperture and at another longitudinal end zone thereof a narrower groove aperture, said support comprising a base body for mounting on a wall and having a male portion, said male portion having a shape substantially mating with the shape of said groove thereby defining together with said groove a dovetail connection system, said male portion having transversal dimensions, which are smaller than transversal dimensions of said larger groove aperture and which are greater than the transversal dimensions of said narrower groove aperture, thereby allowing said male portion to be inserted into said groove at said larger groove aperture and to be locked within said groove, when the relative position of said male portion within said groove is shifted towards said narrower groove aperture.

2. A water dispensing unit according to claim 1, wherein said groove and said male portion of said support have trapezoidal form in cross-section.

3. A water dispensing unit according to claim 1, wherein said male portion of said support is an integral part of said base body.

4. A water dispensing unit according to claim 1, wherein said male portion is a male member and said support comprises a rod rigidly connected with an end thereof to said male member and with another end thereof to said base body, a ball joint between said base body and said other end of said rod for providing swiveling connection therebetween, thereby allowing the adjustment of the angular position of said male member.

5. A water dispensing unit according to claim 1, further comprising a flexible water supply hose element directly attached to said lateral surface of the shower head.

6. A water dispensing unit according to claim 1, wherein said lateral circumferential surface has a recess extending along at least part of the circumference defined by said lateral surface to thereby provide a grip formation for the shower head.

* * * * *